United States Patent [19]

Frangatos

[11] Patent Number: 4,563,299

[45] Date of Patent: Jan. 7, 1986

[54] PHOSPHORUS-CONTAINING REACTION PRODUCTS AS ANTIWEAR AND LOAD CARRYING ADDITIVES FOR LUBRICANTS

[75] Inventor: Gerassimos Frangatos, Haddonfield, N.J.

[73] Assignee: Mobil Oil Corporation, New York, N.Y.

[21] Appl. No.: 656,295

[22] Filed: Oct. 1, 1984

Related U.S. Application Data

[63] Continuation-in-part of Ser. No. 548,056, Nov. 2, 1983, abandoned, which is a continuation-in-part of Ser. No. 418,350, Sep. 15, 1982, abandoned, which is a continuation-in-part of Ser. No. 120,797, Feb. 12, 1980, abandoned.

[51] Int. Cl.[4] ..... C10M 1/20; C10M 1/32; C10M 1/44; C07F 9/28

[52] U.S. Cl. ..... 252/49.9; 260/932

[58] Field of Search ..... 252/32.5, 49.9; 260/932

[56] References Cited

U.S. PATENT DOCUMENTS

| | | | |
|---|---|---|---|
| 2,635,112 | 4/1953 | Fields | 252/49.9 X |
| 2,847,442 | 8/1958 | Sallmann | 252/49.9 X |
| 3,549,728 | 12/1970 | Balde et al. | 252/49.9 X |
| 4,097,389 | 6/1978 | Andress | 252/49.9 X |

*Primary Examiner*—W. J. Shine

*Attorney, Agent, or Firm*—Alexander J. McKillop; Michael G. Gilman; Van D. Harrison, Jr.

[57] ABSTRACT

Excellent antiwear and load-carrying characteristics are imparted to lubricants when dialkyl phosphonates which have undergone condensation reactions with aldehydes and polyamines are incorporated therein.

18 Claims, No Drawings

PHOSPHORUS-CONTAINING REACTION PRODUCTS AS ANTIWEAR AND LOAD CARRYING ADDITIVES FOR LUBRICANTS

CROSS REFERENCE TO RELATED APPLICATIONS

This is a continuation-in-part of co-pending U.S. application Ser. No. 548,056, filed Nov. 2, 1983, which in turn is a continuation-in-part of U.S. application Ser. No. 418,350 filed Sept. 15, 1982, which in turn is a continuation-in-part of U.S. application Ser. No. 120,797, filed Feb. 12, 1980, all now abandoned.

BACKGROUND OF THE INVENTION

1. Field of the Invention

This invention is directed to lubricant compositions having improved antiwear/load-carrying characteristics. More specifically this invention is directed to lubricant compositions wherein such improved characteristics are obtained by incorporating minor amounts of the reaction product of aldehydes and polyamines with dialkyl phosphonates.

2. Description of Prior Art

The metal surfaces of machinery or engines operating under heavy loads wherein metal slides against metal may undergo excessive wear or corrosion. Often the lubricants used to protect the metal surfaces deteriorate under such heavy loads and as a result, do not prevent wear at the points of metal to metal contact. Consequently, the performance of the machine or engine will suffer, and in aggravated cases the machine or engine may become completely inoperative.

There have been many attempts to devise additive systems which would provide satisfactory protection, but these have not always been successful. The phosphonate derivatives of the present invention are believed capable of overcoming some of the deficiencies of prior art additives and capable of providing lubricating oil compositions with enhanced antiwear characteristics.

U.S. Pat. No. 2,758,971 describes a class of metal phosphonates which are disclosed as having properties which prevent breakdown of oils at high temperatures.

In U.S. Pat. No. 2,792,374 are disclosed the alkali metal salts of certain alkyl alkylphosphonic acids as defoamants in aqueous systems.

U.S. Pat. Nos. 2,635,112 and 2,847,442 are primarily concerned with primary and secondary monoamines as reactants with aldehydes and phosphites. They both disclose alkylidenediamine (the latter patent only as part of the prior art discussion), but it should be noted that the product produced by reacting the alkylidenediamine with a phosphite (phosphonate) involves no aldehyde and that during reaction one amino group of splits off. Thus it produces products having only one amino group.

U.S. Pat. No. 3,549,728 discloses products similar to those of the previous two patents mentioned.

U.S. Pat. No. 2,982,727 discloses lubricating oil compositions containing certain salts of oxygen-containing esters of phosphorous. The esters are phosphonates similar to those described in U.S. Pat. No. 2,758,971.

No prior art patent or literature exists to applicant's knowledge, describing the phosphonate derivatives of the present invention.

SUMMARY OF THE INVENTION

The present invention provides lubricant compositions comprising a lubricant and an antiwear/load-carrying amount of a product comprising a compound prepared by a condensation reaction wherein an aldehyde and a polyamide are reacted with a dialkyl phosphonates.

DESCRIPTION OF SPECIFIC EMBODIMENTS

The dialkyl phosphonates useful in preparing the additives of this invention will generally have from 1 to about 30 carbon atoms per alkyl group. Typical phosphonates include dimethyl phosphonate, dibutyl phosphonate, dioctyl phosphonate, dioctyl phosphonate, di-tridecyl phosphonate, di-tetradecyl catechol phosphonate, diisodecyl phosphonate, mixtures thereof and mixtures of such mono- and dialkyl phosphonates.

The polyamines useful in preparing the reaction products of this invention include amines derived from primary, and secondary alkylamine, wherein the alkyl group contains from 1 to about 30 carbon atoms, primary, and secondary arylamines, the aryl group containing from 6 to about 30 carbon atoms; polyalkylenepolyamines such as ethylenediamine, diethylenetriamine, triethylenetetramine, tetraethylenepentamine, pentaethylenehexamine, nonaethylenedecamine, and the like are preferred.

The aldehydes useful in the preparation of additive compounds in accordance with this invention may be derived from any suitable $C_1$ to $C_{30}$ hydrocarbyl group or aliphatic compound such as a $C_1$ to $C_{30}$ alkane, a $C_2$ to $C_{30}$ alkene, a $C_2$ to $C_{30}$ alkyne or $C_6$–$C_{30}$ aryl or alkaryl compounds. Typical aldehydes include formaldehyde; acetaldehyde; propionaldehyde; n-butyraldehyde; heptaldehyde; phenylacetaldehyde; benzaldehyde; naphthaldehyde; tolualdehyde; and salicylaldehyde.

Highly useful products can be made by reacting from 1 mole to about 4 moles of dialkyl phosphonate, preferably 1 mole, with 1 mole of aldehyde and 0.2 to 5 moles of amine. The temperature of reaction may range from about 50° C. to about 250° C., preferably about 50° C. to about 150° C., depending upon the specific reactants used. Also the reaction times may vary within wide limits, e.g., from about 1 hour to about 10 hours depending upon reactants and conditions used.

The products disclosed herein are products of reaction in which enough phosphonate and aldehyde are used to react with all the amino groups in the particular amine being used. Thus, from the nature of the reaction involved, the product will comprise a compound in which all N-groups have a $—CH_2—P(O)(OR)_2$ attached thereto. For example, in the case of a reaction including ethylenediamine, formaldehyde and dialkyl phosphonate one will obtain a product comprising compounds of the formulas

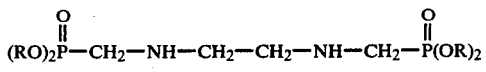

and/or

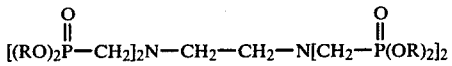

and comparable members having from 3 to 10 amino groups. That is, the product will comprise a compound of the formula

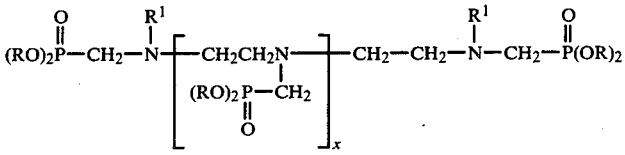

wherein R may be the same or different $C_1$ to $C_{30}$ alkyl group and $R^1$ is hydrogen or a $—CH_2—P(O)(OR)_2$ group and x is 1 to 8.

Broadly, the product of the invention will comprise a compound of the formula

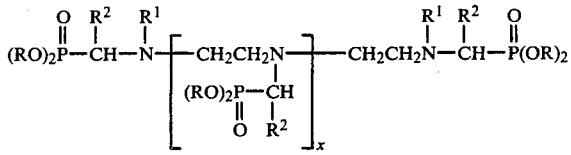

wherein R and x are as defined hereinabove, $R^2$ is hydrogen or a $C_1$ to $C_{30}$ hydrocarbyl group and $R^1$ is hydrogen or a

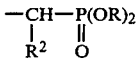

group wherein R and $R^2$ are as defined. Preferably x is 3 and r is methyl or butyl.

The lubricants which are improved by the reaction products of this invention are mineral and synthetic lubricating oils and greases therefrom. Preferably the oil of lubricating viscosity is selected from mineral oils, mineral oil fractions, synthetic oils and mixed mineral and synthetic oils. The mineral oils will be understood to include not only the paraffinic members, but also the naphthenic members. By synthetic oils are meant synthetic hydrocarbons, polyalkylene oxide oils, polyacetals, polysilicones and the like, as well as synthetic ester oils. Included among the latter type are those esters made from monohydric alcohols and polycarboxylic acids, such as 2-ethylhexylazelate and the like. Also included are those esters made from polyhydric alcohols and aliphatic monocarboxylic acids. Those of this group are especially important and in this group are found esters prepared from (1) the trimethylols, such as the ethane, propane and butane derivatives thereof and 2,2-disubstituted propane diols and (2) the pentaerythritols reacted with aliphatic monocarboxylic acids containing from about 4 to 9 carbon atoms. Mixtures of these acids may be used to prepare the esters. Preferred among the esters are those made from pentaerythritol and a mixture of $C_5$ to $C_9$ acids.

As has been indicated, the reaction products disclosed herein are useful as antiwear and load carrying agents. When so used, they are added in minor amounts sufficient to impart such properties to the lubricant. Generally, these amounts will range from about 0.25% to about 10% by weight, preferably from about 0.5% to about 2%, of the product used based on the weight of the total composition.

Having discussed the invention in broad and general terms, the following are offered to illustrate it. It is to be understood that the Examples are merely illustrative and are not intended to limit the scope of the invention.

EXAMPLE 1

A mixture of methanol (100 ml.) dimethyl phosphonate (55 g., 0.5 mole) tetraethylenepentamine (TEPA; 18.9 g., 0.1 mole) paraformaldehyde (18 g. equivalent of 0.6 mole of formaldehyde) and formic acid (2 g.) was stirred under nitrogen. Exothermic reaction occurred and the temperature of the reaction mixture reached 46° without external heating. The reaction mixture was subsequently brought to reflux temperature under nitrogen and with stirring. Stirring and refluxing were maintained for two hours. The solvent and any volatiles were distilled off under reduced pressure. The final pot temperature was 125° C. The residue, a viscous fluid, weighted 81 gms.

EXAMPLE 2

A mixture of tetraethylenepentamine (TEPA; 18.9 g., 0.1 mole), dibutyl phosphonate (97 g., 0.5 mole) benzaldehyde (53 g., 0.5 mole) and toluene 150 ml. was placed in a flask equipped with stirrer, reflux condenser, thermometer, nitrogen inlet tube and water trap. The reaction mixture was stirred and refluxed for three hours. Water collected: 9 ml., 0.5 mole). The solvent and any volatiles were distilled off under reduced pressure. The final pot temperature was 135° C. Yield: 160 gms.

EVALUATION OF THE PRODUCTS

The product of Example 1 was tested in the 4-Ball Test using a modified 4-Ball machine. In this test, three stationary balls are placed in a lubricant cup and a lubricant containing the additive to be tested is added thereto. A fourth ball is placed on a chuck mounted on a device which can be used to spin the ball at known speeds and loads.

To a 100 cc of a lubricating oil comprising an 80–20 mixture, respectively, a 150″ solvent paraffinic bright mineral oil (at 210° F.) and 200″ solvent paraffinic neutral mineral oil (at 100° F.) was added an effective amount about 1 wt. % of the product of Example 1. Table 1 summarizes the results.

The product of Example 2 was tested under the same conditions and in the same oil. Results are summarized in Table 2. An untreated sample of the above-described oil was tested in identical manner to that used for Examples 1 and 2; results are disclosed at bottom of Table 2.

TABLE 1

| Temperature | | Room Temperature | | | | 200° F. | | | | 390° F. | | | |
|---|---|---|---|---|---|---|---|---|---|---|---|---|---|
| rpm | | 500 | 1000 | 1500 | 2000 | 500 | 1000 | 1500 | 2000 | 500 | 1000 | 1500 | 2000 |
| Load, Kg | | 60 | 60 | 60 | 60 | 60 | 60 | 60 | 60 | 60 | 60 | 60 | 60 |
| Time, Minutes | | 30 | 30 | 30 | 30 | 30 | 30 | 30 | 30 | 30 | 30 | 30 | 30 |
| Average Scar Diam. | | | | | | | | | | | | | |
| Horizontal | 1 | 0.6 | 0.7 | 1.3 | 1.9 | 0.6 | 0.8 | 1.3 | 1.9 | 1.0 | 0.8 | 1.1 | 2.0 |
| | 2 | 0.6 | 0.7 | 1.4 | 1.8 | 0.6 | 0.8 | 1.4 | 2.0 | 1.0 | 0.8 | 1.1 | 2.0 |
| | 3 | 0.6 | 0.7 | 1.5 | 1.8 | 0.6 | 0.8 | 1.4 | 2.0 | 1.0 | 0.8 | 0.8 | 2.1 |
| Vertical | 1 | 0.6 | 0.7 | 1.5 | 2.0 | 0.6 | 0.8 | 1.5 | 2.1 | 1.0 | 0.8 | 1.1 | 2.2 |
| | 2 | 0.6 | 0.7 | 1.5 | 1.9 | 0.6 | 0.8 | 1.5 | 2.1 | 1.0 | 0.8 | 1.1 | 2.1 |
| | 3 | 0.6 | 0.7 | 1.5 | 1.9 | 0.6 | 0.9 | 1.5 | 2.1 | 1.0 | 0.8 | 1.1 | 2.2 |
| Final Average | | 0.6 | 0.7 | 1.5 | 1.9 | 0.6 | 0.8 | 1.4 | 2.0 | 1.0 | 0.8 | 1.1 | 2.1 |

TABLE 2

| Temperature | | Room Temperature | | | | 200° F. | | | | 390° F. | | | |
|---|---|---|---|---|---|---|---|---|---|---|---|---|---|
| rpm | | 500 | 1000 | 1500 | 2000 | 500 | 1000 | 1500 | 2000 | 500 | 1000 | 1500 | 2000 |
| Load, Kg | | 60 | 60 | 60 | 60 | 60 | 60 | 60 | 60 | 60 | 60 | 60 | 60 |
| Time, Minutes | | 30 | 30 | 30 | 30 | 30 | 30 | 30 | 30 | 30 | 30 | 30 | 30 |
| Average Scar Diameter | | | | | | | | | | | | | |
| Horizontal | 1 | 0.4 | 0.5 | 0.5 | 0.6 | 0.5 | 0.5 | 0.6 | 0.7 | 0.5 | 0.6 | 0.6 | 0.8 |
| | 2 | 0.4 | 0.4 | 0.5 | 0.6 | 0.5 | 0.6 | 0.5 | 0.7 | 0.5 | 0.6 | 0.6 | 0.8 |
| | 3 | 0.4 | 0.5 | 0.5 | 0.6 | 0.5 | 0.6 | 0.6 | 0.6 | 0.5 | 0.6 | 0.6 | 0.8 |
| Vertical | 1 | 0.4 | 0.5 | 0.5 | 0.6 | 0.5 | 0.6 | 0.6 | 0.7 | 0.5 | 0.6 | 0.7 | 0.8 |
| | 2 | 0.4 | 0.5 | 0.5 | 0.6 | 0.5 | 0.6 | 0.6 | 0.7 | 0.5 | 0.6 | 0.6 | 0.8 |
| | 3 | 0.4 | 0.5 | 0.5 | 0.6 | 0.5 | 0.6 | 0.6 | 0.6 | 0.5 | 0.6 | 0.6 | 0.8 |
| Final Average | | 0.4 | 0.5 | 0.5 | 0.6 | 0.5 | 0.6 | 0.6 | 0.7 | 0.5 | 0.6 | 0.6 | 0.8 |
| Untreated Oil | | | | | | | | | | | | | |
| Final Average | | 0.8 | 0.9 | 2.5 | 3.1 | 0.8 | 2.0 | 2.6 | 2.7 | 1.0 | 2.4 | 3.1 | 2.9 |

What is claimed:

1. A lubricant composition comprising a major proportion of an oil of lubricating viscosity or grease prepared therefore and a minor antiwear or load-carrying amount of a product comprising a compound of the formula

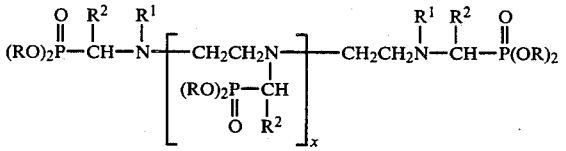

wherein the R groups are the same or different and are selected from alkyl groups containing 1 to 30 carbon atoms, $R^2$ is hydrogen or a $C_1$ to $C_{30}$ hydrocarbyl group, x is 1 to 8 and $R^1$ is hydrogen or a

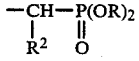

group wherein R and $R^2$ are as defined herein.

2. The composition of claim 1 in x is 3.

3. The composition of claim 2 in which R is methyl or butyl.

4. The composition of claim 2 in which the $R^2$ has the structural formula:

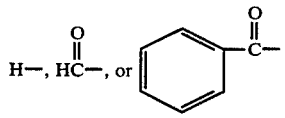

5. The composition of claim 4 in which $R^2$ has the structural formula:

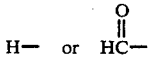

and R is methyl.

6. The composition of claim 4 in which the aldehyde is benzaldehyde and the dialkyl phosphonate is dibutyl phosphonate.

7. The composition of claim 1 comprising from about 0.25 to about 10% by weight of said product.

8. The composition of claim 7 comprising about 1 wt. % of said product.

9. The composition of claim 1 wherein the oil of lubricating viscosity is selected from mineral oils, mineral oil fractions, synthetic oils and mixed mineral and synthetic oils.

10. The composition of claim 9 wherein the oil of lubricating viscosity is a mineral oil.

11. The composition of claim 10 wherein the lubricant is a grease.

12. A product comprising a compound of the formula

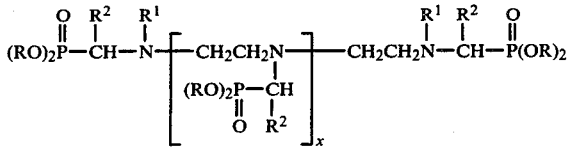

wherein the R groups are the same or different and are selected from alkyl groups containing 1 to 30 carbon atoms, $R^2$ is hydrogen or a $C_1$ to $C_{30}$ hydrocarbyl group, x is 1 to 8 and $R^1$ is hydrogen or a

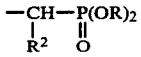

group wherein R and $R^2$ are as defined herein.

13. A product as defined in claim 12 wherein x is 3.

14. A product as defined in claim 12 wherein $R^3$ is hydrogen.

15. A product as defined in claim 12 wherein R is methyl.

16. A product as defined in claim 12 wherein R is butyl.

17. A product as defined in claim 12 wherein R is methyl, x is 3 and $R^3$ is hydrogen.

18. A product as defined in claim 12 wherein R is butyl, x is 3 and $R^3$ is hydrogen.

* * * * *